United States Patent [19]

Lovejoy

[11] 4,331,096

[45] May 25, 1982

[54] DIVER OPERATED RETRACTABLE PAD EYE

[75] Inventor: Richard E. Lovejoy, Panama City, Fla.

[73] Assignee: The United States of America as represented by the Secretary of the Navy, Washington, D.C.

[21] Appl. No.: 207,853

[22] Filed: Nov. 18, 1980

[51] Int. Cl.[3] ..... B63B 21/04

[52] U.S. Cl. ..... 114/218; 410/107

[58] Field of Search ..... 114/177, 211, 218, 51; 410/101, 102, 103-106, 107, 109, 108, 110, 111, 112, 116, 114, 115; 248/499, 500, 503

[56] References Cited

U.S. PATENT DOCUMENTS

| | | | |
|---|---|---|---|
| 1,402,496 | 1/1922 | Hoffman | 114/218 |
| 3,298,652 | 1/1967 | Burdick | 410/107 |
| 3,897,746 | 8/1975 | Jamieson | 114/218 |
| 4,270,478 | 6/1981 | Kafka et al. | 114/218 |

*Primary Examiner*—Trygve M. Blix
*Assistant Examiner*—Jesús D. Sotelo
*Attorney, Agent, or Firm*—Richard S. Sciascia; Harvey A. David

[57] ABSTRACT

A retractable pad-eye device for use in association with a plate-like wall having an opening includes a closure member for the opening and a pad-eye member, each connected by a jack-screw to a pivot-block that is rotatable mounted relative to the wall. By operation of the jack-screws with a wrench and rotation of the pivot-block, the closure member and the pad-eye member can be alternatively shifted between retracted or storage positions and operative positions in the opening.

15 Claims, 3 Drawing Figures

DIVER OPERATED RETRACTABLE PAD EYE

BACKGROUND OF THE INVENTION

This invention relates to devices adapted to be incorporated into the hull or housing of underwater apparatus for the purpose of providing attachment points for connection of lifting, hoisting, or tie down devices.

Present day submersibles or submarines are often fitted with external auxiliary equipment for a variety of scientific and military purposes. Such equipment may be only intermittently installed or may require periodic removal for upkeep or replacement. The provision of fixed and protruding or exposed pad-eyes leads to drag and turbulance that cannot be tolerated at relatively high speed operation.

It has been proposed in the past to provide recessed eyes for connection of hoisting gear, with a removable cover plate secured thereover during periods of non-use to provide a relatively smooth surface and reduced turbulance and drag. U.S. Pat. No. 1,826,959 provides an example of such a construction. The device of that patent is, however, limited to application at the location of a rib or bulkhead, includes a turbulence causing rim about the recess, and the cover plate must be completely removed and so is subject to being readily lost.

SUMMARY OF THE INVENTION

With the foregoing in mind, it is a principal object of this invention to provide a novel and particularly useful device that presents, in one operative position, a substantially flush cover plate, and in another operative position, a pad-eye that affords a strong and reliable point of connection.

Another object of the invention is the provision of a convertible pad-eye device that is self-storing when not in use and yet is easily and quickly brought to its operative position ready for connection thereto, for example by a hook, strap, or other attachment means.

Still another object is the provisions of a pad-eye or connection device of the foregoing character, that can conveniently be mounted beneath or behind a deck or hull wall at locations other than at ribs or bulkheads.

As another object, the invention aims to provide an improved self-storing pad-eye device that can be easily operated by a diver using a single wrench and which has no removable cover, screws, or other parts which may become fully disengaged or lost.

The invention may further be said to reside in certain novel constructions, combinations, and associations of parts by which the foregoing objects and advantages are achieved, together with others that will become apparent from the following detailed description of a presently preferred embodiment when read in conjunction with the accompanying drawings forming a part of this specification.

DESCRIPTION OF THE PREFERRED EMBODIMENT

Figure 1:
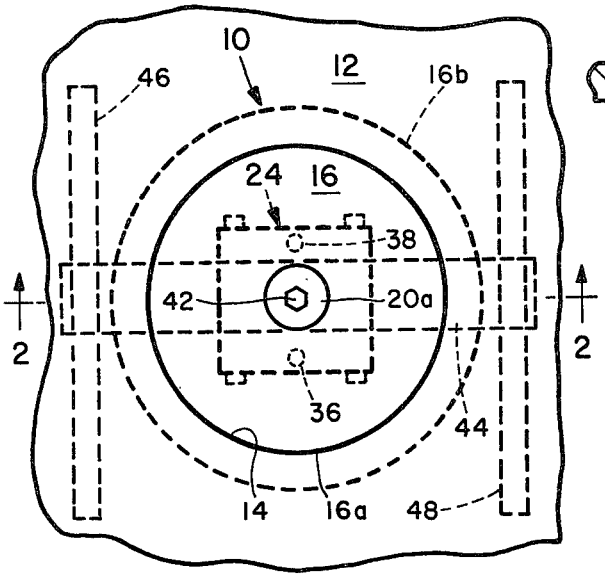
FIG. 1 is a plan view of a retractable pad-eye device embodying the invention, shown in association with supporting structure and in retracted condition.

In the form of the invention illustrated in the drawings and described hereinafter, there is provided a retractable pad-eye device, indicated generally at 10, that is particularly suited to use in association with underwater apparatus having a deck, hull, or housing wall 12 having outside and inside surfaces 12*a* and 12*b*, respectively. The wall 12 is provided with an aperture 14 which, in this example, is circular although other shapes, such as rectangular, can be used.

Figure 2:
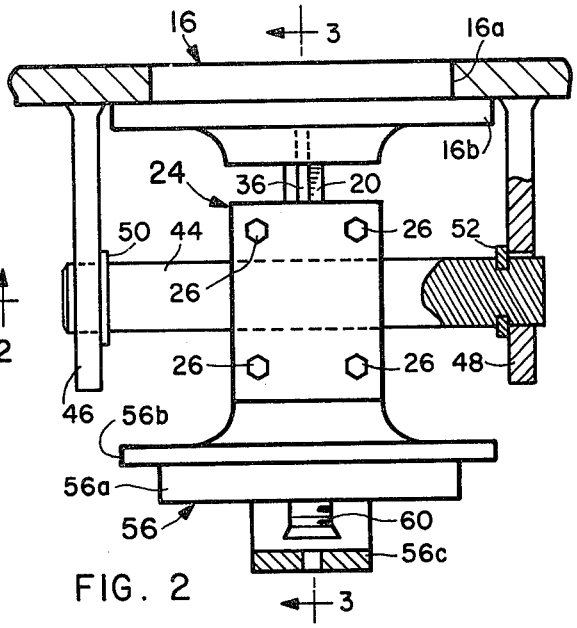
FIG. 2 is a side view, partly in section, illustrating the device of FIG. 1, as viewed substantially along line 2—2 thereof.
Figure 3:
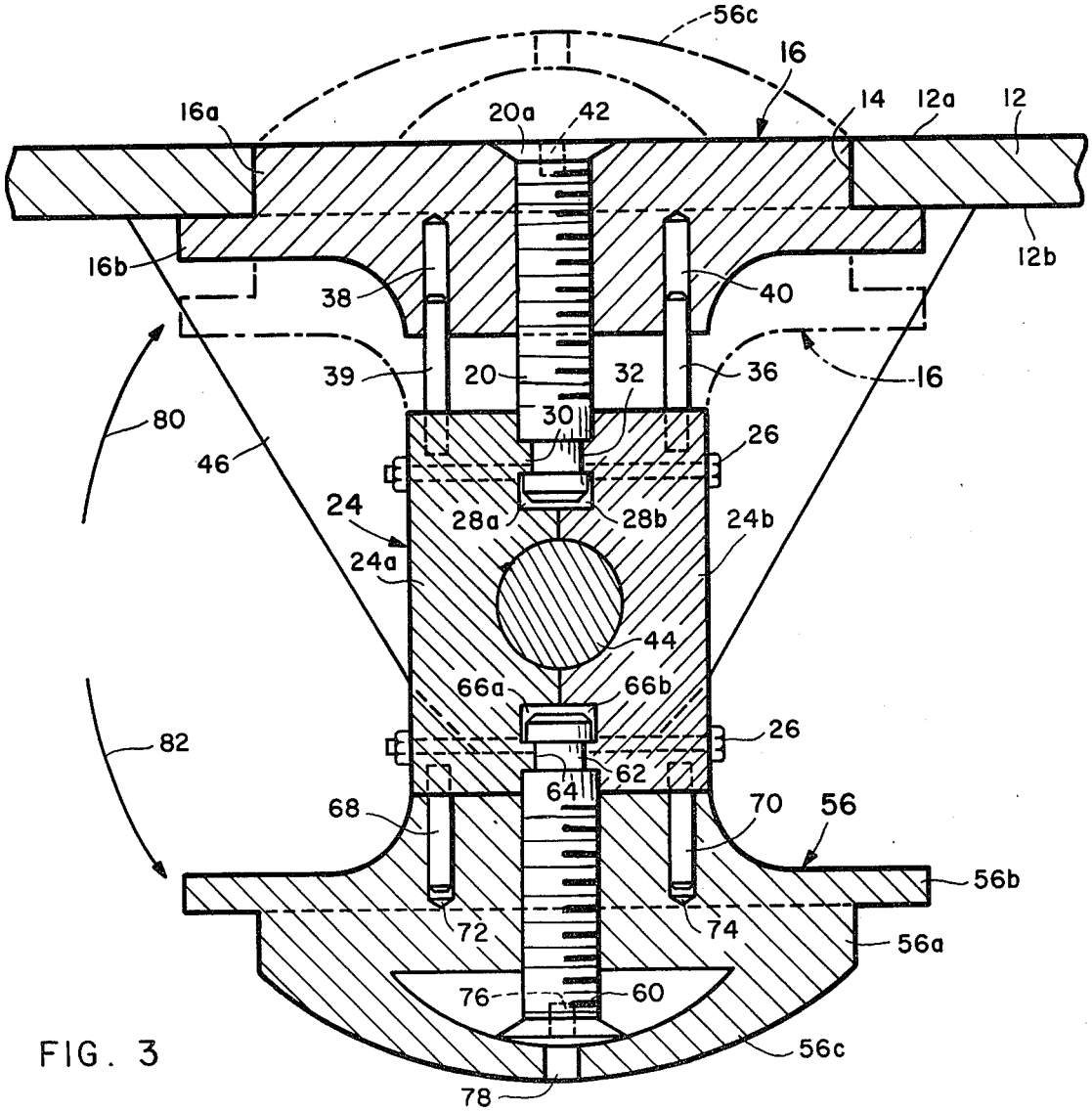
FIG. 3 is a sectional view of the device, on an enlarged scale, as viewed substantially along line 3—3 of FIG. 2.

The device 10 comprises an aperture closure member 16 of a configuration corresponding to the aperture 14. As is best seen in FIGS. 2 and 3, the closure member 16 comprises an obturating portion 16*a* received in the aperture 14, and a flange portion 16*b* adapted to lie against the inside surface 12*b* of wall 12.

The closure member 16 is connected by means of a jack-screw 20, operable in a threaded bore 22 of the closure member, to a pivot-block, indicated generally at 24 and conveniently comprising pivot-block halves 24*a* and 24*b* secured together bolts 26. The pivot-block halves 24*a*, 24*b* are provided with cooperating recesses 28*a*, 28*b* that receive one end of the jack-screw 20 and define an annular rib 30 that is engaged in a groove 32 of the jack-screw and allows rotation thereof while preventing axial movement of the jack-screw relative to the pivot-block.

A pair of guide pins or rods 34,36 are fixed in the pivot-block 24 and extend outwardly therefrom parallel to the axis of the jack-screw 20. The guide rods 34 extend into parallel guide bores 38, 40, respectively, in the closure member 16 and serve to prevent rotation of that member when the jack-screw 20 is rotated. Rotation of the jack-screw 20 in one direction or the other, for example by means of a hexagonal wrench (not shown) fit into a corresponding hexagonal socket 42 in the head portion 20*a* of that screw, will cause the closure member 16 to move toward or away from the pivot-block 24 for purposes which will presently be made apparent. The head portion 20*a* of the screw 20 is preferably conical to seat flush in a corresponding recess in the member 16. Other shapes of flush screw heads may, of course, be used.

The pivot-block 24 is supported for revolving or rotating movement, about an axis parallel to the wall 12, by a trunnion shaft 44 that is received and clamped in semi-cyldrical grooves in the pivot-block halves 24*a*, 24*b*. The outer ends of the shaft 44 are journalled in axially aligned openings in parallel, spaced trunnion bearing plates 46,48 that are conveniently welded to the wall 12 and extend inwardly from the surface 12*b* on either side of the opening 14. Retainer rings 50,52 disposed in corresponding grooves in shaft 44 cooperate with the plates 46,48 to prevent lateral shifting of the device.

Disposed on the side of the pivot-block 24 opposite the closure member 16 is a pad-eye member 56 comprising an obturating portion 56*a*, a flange portion 56*b*, and an eye portion or bail 56*c*. The member 56 is connected to the pivot-block 24 by a jack-screw 60, similar to screw 20, having a groove 62 receiving an annular rib 64 defined in cooperating recesses 66*a*, 66*b* in the pivot-block halves 24*a*, 24*b*. A pair of guide pins or rods 68,70 are fixed in the pivot-block 24 and extend into cooperating guide bores 72,74 in the pad-eye member 60. The head portion 60*a* of the screw 60 has a wrench receiving socket 76 in allignment with an access opening 78 in the bail 56c.

MODE OF OPERATION

When it is desired to change the device 10 from its pad-eye stored condition illustrated in the drawings in full lines, a hexagonal wrench is inserted into the socket 42 of jack-screw 20 and rotated in a direction that causes the member 16 to travel toward its single dot and dash line position of FIG. 3. When the member 16 has reached that position, the wrench is removed and the device 10 can be rotated about its trunnion axis as shown by arrow 80 to bring the pad-eye member 56 into registration with the opening 14 in wall 12. Thereafter, the wrench may be inserted through opening 78 into the socket 76 of the jack-screw 60 and the latter rotated in a direction to cause the pad-eye member 56 to move into the double dot and dash position of FIG. 3. In that position, the obturator portion 56a fills the opening 14, while the flange portion 56b engages the inner surface 12b of wall 12 around that opening. The device 10 is then ready for use by engagement of the bail 56c to lift, hoist or secure the hull or housing of which the wall 12 forms a part.

When it is desired to return the pad-eye member 56 to its storage position, the jack-screw 60 is operated to retract that member to allow the device 10 to revolve or rotate as shown by arrow 82. With the closure member 16 aligned with the opening 14, the jack-screw 20 is operated to move the closure member away from the pivot-block 24 to again close the opening 14.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A retractable pad-eye device in combination with a plate forming part of a hull or housing and having inner and outer surfaces and an opening therethrough, said device comprising:

pivot-block means;

trunnion means supporting said pivot-block means for rotation about an axis parallel to and spaced from said inner surface;

a closure member;

a pad-eye member having a bail;

first and second means operatively connecting said closure member and said pad-eye member to said pivot-block means for rotation therewith about said axis to selectively bring said closure member and said pad-eye member alternatively into registration with said opening;

said first means being operable, when said closure member is in registration with said opening, to move said closure member into and out of engagement with said plate and closing relation to said opening; and said second means being operable, when said pad-eye member is in registration with said opening, to move said pad-eye member into and out of engagement with said plate and closing relation to said opening with said bail exposed for attachment.

2. A device as defined in claim 1, and wherein:

said first and second means comprise first and second jack-screws.

3. A device as defined in claim 2, and wherein:

said pivot-block means comprises first and second pivot-block halves and means for securing said halves together.

4. A device as defined in claim 2, and wherein: p1 said trunnion means comprises a trunnion shaft extending from opposite sides of said pivot-block means, and trunnion bearing means fixed to said plate and having said trunnion shafts journalled therein.

5. A device as defined in claim 2, and wherein:

said closure member comprises an obturator portion and a flange portion, said obturator portion having a complementary configuration engageable in said opening with said flange portion bearing against said inner surface of said plate, and said obturator portion presenting a substantially flush surface with said outer surface of said plate.

6. A device as defined in claim 2, and wherein:

said pad-eye member comprises an obturator portion and a flange portion, said obturator portion having a complementary configuration engageable in said opening with said flange portion bearing against said inner surface of said plate, said obturator portion presenting a substantially flush surface with said outer surface of said plate, and said bail projecting outwardly of said flush surface and said outer surface.

7. A device as defined in claim 2, and further comprising:

guide means cooperating between said closure member and said pivot-block means and between said pad-eye member and said pivot-block means, said guide means being operative to constrain said closure member and said pad-eye member to translational movements relative to said pivot-block means.

8. A device as defined in claim 7, and wherein:

said guide means comprises cooperating rods and guide bores, said rods having sliding fits in corresponding guide bores.

9. A retractable pad-eye device in combination with a structure including a plate-like wall having inner and outer sufaces and an opening therethrough of predetermined configuration, said device comprising:

a closure member having an operative position in said opening and a storage position remote from said opening;

a pad-eye member having an operative position in said opening and a storage position remote from said opening;

a pivot member;

means supporting said pivot member in spaced relation to said wall for rotation about a predetermined axis.

first and second connecting means supporting said closure member and said pad-eye member on said pivot member whereby rotation thereof about said axis between first and second rotative positions will alternatively move said closure member and said pad-eye member from their respective storage positions to intermediate positions in registration with said opening;

said first connecting means being operative to move said closure member between said operative and said intermediate positions thereof when said pivot member is in one of said rotative positions;

said second connecting means being operative to move said pad-eye menber between said operative and intermediate positions thereof when said pivot member is in the other of said rotative positions.

10. A device as defined in claim 9, and wherein:

said means supporting said pivot member comprises a trunnion shaft and trunnion bearing means.

11. A device as defined in claim 10, and wherein:

said first and second connecting means comprise first and second jackscrews.

12. A device as defined in claim 11, and wherein:

said first and second connecting means further comprise guide bore and rod means for constraining said closure member and said pad-eye member against rotation relative to said pivot member.

13. A device as defined in claim 12, and wherein:

said closure member and said pad-eye member each comprise an obturator portion and a flange portion adapted respectively to fill said opening and to bear against said inner surface of said wall.

14. A device as defined in claim 13, and wherein:

said pad-eye member further comprises a bail defining an eye, said bail spanning said obturator portion.

15. A device as defined in claim 14, and wherein:

said first and second jack-screws are threadedly engaged in said closure member and said pad-eye member, respectively, each of said screws being rotatably connected to said pivot member.

* * * * *